US009919448B2

(12) United States Patent
van Kleef

(10) Patent No.: US 9,919,448 B2
(45) Date of Patent: Mar. 20, 2018

(54) ARTICLE HANDLING AND MANUFACTURING

(71) Applicant: Bohnert Equipment Company, Inc., Louisville, KY (US)

(72) Inventor: Ericus Andreas van Kleef, Louisville, KY (US)

(73) Assignee: Bohnert Equipment Company, Inc., Louisville, KY (US)

( * ) Notice: Subject to any disclaimer, the term of this patent is extended or adjusted under 35 U.S.C. 154(b) by 601 days.

(21) Appl. No.: 14/517,359

(22) Filed: Oct. 17, 2014

(65) Prior Publication Data

US 2015/0107718 A1 Apr. 23, 2015

Related U.S. Application Data

(60) Provisional application No. 61/892,795, filed on Oct. 18, 2013.

(51) Int. Cl.
*B27H 5/00* (2006.01)
*B27M 1/08* (2006.01)

(52) U.S. Cl.
CPC ..... *B27H 5/00* (2013.01); *B27M 1/08* (2013.01); *Y10T 29/4987* (2015.01); *Y10T 29/49947* (2015.01)

(58) Field of Classification Search
CPC ..... B27H 5/00; B27M 1/08; Y10T 29/49947; Y10T 29/4987
See application file for complete search history.

(56) References Cited

U.S. PATENT DOCUMENTS 1,298,489 A * 3/1919 Frelinghuysen et al. ..... B08B 9/0804 134/129
4,628,972 A * 12/1986 LaRochelle ..... B05B 1/14 134/133
5,000,661 A * 3/1991 Bloch ..... B67C 7/0006 141/1
5,368,652 A * 11/1994 Mullinax ..... B08B 9/0821 134/22.18
5,662,226 A * 9/1997 Till ..... B08B 9/46 141/94

* cited by examiner

*Primary Examiner* — Faye Francis
(74) *Attorney, Agent, or Firm* — Middleton Reutlinger

(57) ABSTRACT

An apparatus, system, and process for handling and/or manufacturing articles. At least one article support configured to support an article is coupled to a transfer beam configured to reciprocally move along a first axis. The reciprocal movement of the transfer beam moves the at least one article support between two stations, such that an article supported by the article support may be conveyed between the two stations.

31 Claims, 15 Drawing Sheets

ARTICLE HANDLING AND MANUFACTURING

CROSS-REFERENCE TO RELATED APPLICATIONS

This application claims priority to U.S. Provisional Application Ser. No. 61/892,795 filed by Ericus Vankleef on Oct. 18, 2013, and entitled "BARREL HANDLING AND MANUFACTURING," which application is incorporated by reference in its entirety.

FIELD OF THE INVENTION

Embodiments of the invention are generally related to apparatuses, systems, and processes for handling and manufacturing articles.

BACKGROUND

In some conventional manufacturing, labor and processes may be reliant on manual labor and oversight due to material inconsistencies, material characteristics, article shape, article size, article durability, and/or other such properties of an article being manufactured. For example, in some industries manufacturing articles at least partially composed of wood, the material inconsistencies of the wood may lead to inefficient and/or error prone manufacturing processes. Hence, characteristics of a manufactured article and/or characteristics of one or more materials used in manufacture thereof may lead to manufacturing inefficiency and/or errors.

As a particular example, in the cooperage industry (i.e., the manufacture of wooden barrels), wooden staves of a barrel may vary dimensionally (e.g., width, length, depth, etc.) as well as structurally (e.g., the grain of the wood may vary). Such inconsistencies in the wood may present issues when handling and/or processing barrels. Therefore, in some conventional barrel manufacturing, labor and processes may often be reliant on manual labor and oversight. In turn, manufacture of the barrels may be inefficient and/or error prone. In particular, machinery used in processing wooden barrels may function incorrectly, handle the wooden barrel in such a way that the barrel is damaged, and/or completely destroy a wooden barrel. Other types of materials may present difficulties in handling and manufacture.

Therefore, a continuing need exists in the art for improved article handling and manufacturing processes, apparatuses, and systems.

SUMMARY

Embodiments of the invention address these and other problems associated with the prior art by providing an article handling and manufacturing apparatus, system, and process. Consistent with embodiments of the invention, articles may be conveyed using an apparatus that comprises one or more article supports coupled to a transfer beam. The one or more article supports may be configured to support an article. The transfer beam may be configured to convey a supported article by reciprocally moving the one or more article supports between two stations and/or areas along a first axis. In some embodiments of the invention, the apparatus, system, and process may be configured for barrel manufacturing. In these embodiments, the article supports may be configured to support a barrel, and the transfer beam may be configured to convey a supported barrel by reciprocally moving one or more barrel supports between two stations and/or areas.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Figure 1:
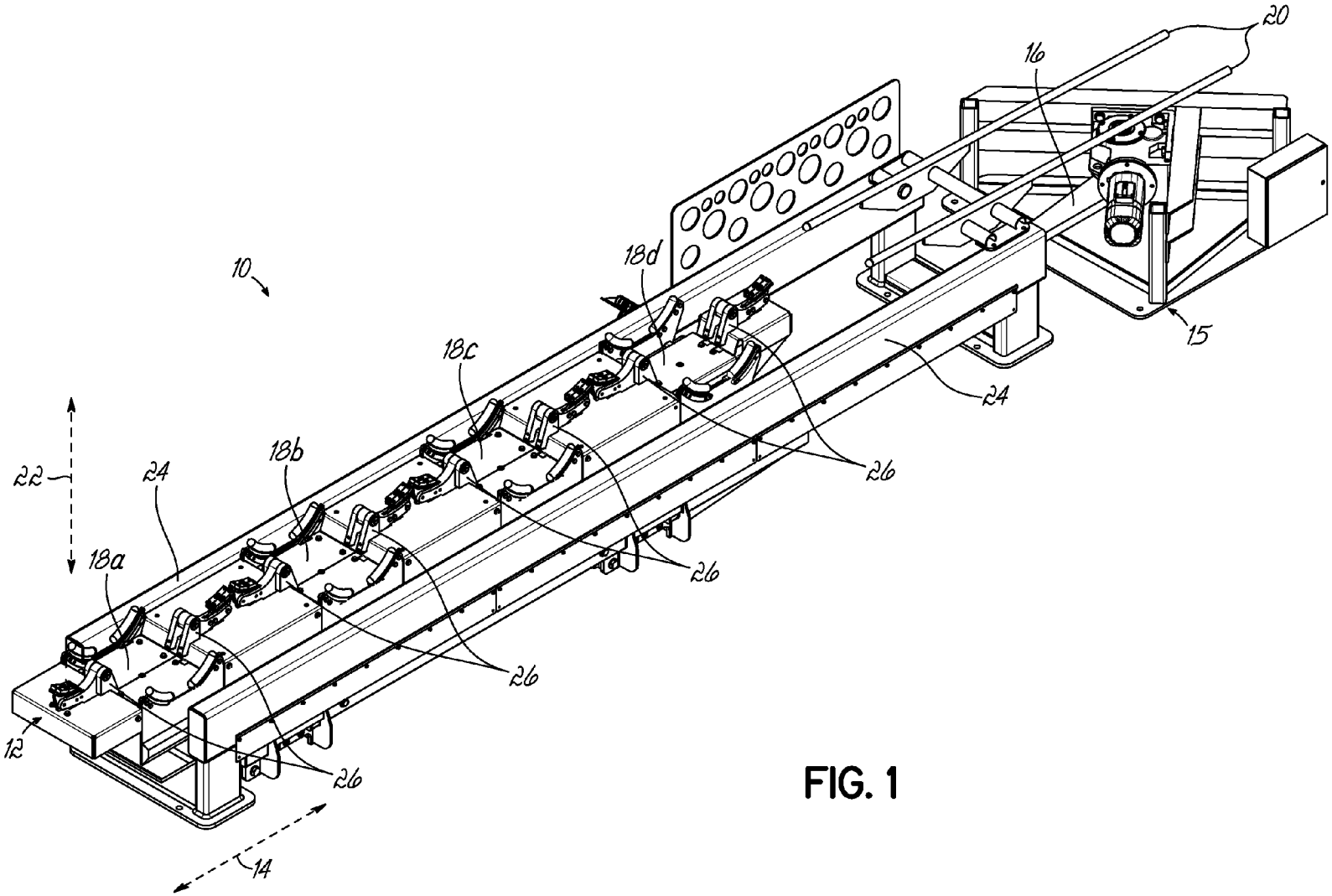
FIG. 1 provides an isometric view of an apparatus consistent with some embodiments of the invention.

Embodiments of the invention provide a system, apparatus, and process for conveying, handling, and/or manufacturing articles. As will be appreciated, an article, as used herein may refer to an article at various stages of a manufacturing process, including from prior to an initial manufacturing/processing stage to after a final manufacturing/processing stage. In some embodiments the articles are barrels at various stages of completion. While further disclosure is directed to embodiments corresponding the handling and manufacturing of barrels, one skilled in the art with the knowledge of the instant disclosure will appreciate that other embodiments of the invention may be configured to handle and/or convey other types of articles. For example, some embodiments of the invention may comprise one or more article supports coupled to a transfer beam configured to support a type of article for conveyance, handling, and/or manufacturing.

In some embodiments, a transfer beam may be coupled to a first drive such that the transfer beam may be reciprocally conveyed along a first axis. In general, the first axis may be a horizontal axis generally parallel to a support surface (e.g., a floor). In such embodiments, the transfer beam may be reciprocally moved between a first horizontal position and a second horizontal position such that article supports may be reciprocally moved between two positions, where the positions may correspond to an entry station, processing stations, transfer stations, an exit station, and/or a handling area. In some embodiments a transfer beam may be coupled to a second drive such that the transfer beam may be moved between at least two positions along a second axis. In general, the second axis may be a vertical axis generally orthogonal to a support surface and the first axis. Hence, in some embodiments, the transfer beam may be reciprocally moved between a first vertical position and a second vertical position. In some embodiments, movement of the transfer beam along the first and second axis may be independently actuated via the first and second drives. In some embodiments, an article may be loaded into and/or unloaded from an article support through movement of the transfer beam along the second axis between two positions. In other embodiments, an article may be loaded into and/or unloaded from an article support of the transfer beam with one or more article loading/unloading devices that engage an article to thereby hold the article for unloading and disengage an article to thereby release the article for unloading.

As will be appreciated, an article may be loaded into a first article support positioned at a first station. A transfer beam coupled to the first article support may be moved from a first horizontal position to a second horizontal position to thereby move the first article support from the first station to a second station. At the second station, the article may be unloaded from the first article support, and the transfer beam may be moved from the second horizontal position to the first horizontal position such that the first article support is positioned at the first station and a second article support coupled to the transfer beam is positioned at the second station. The article may then be loaded into the second article support when the second article support is positioned at the second station. The transfer beam may be moved from the first horizontal position to the second horizontal position such that the second article support is positioned at a third station and the first article support is position at the second station. The article may be unloaded from the second barrel support at the third station, and the transfer beam may be moved from the second horizontal position to the first horizontal position such that a third article support may be positioned at the third station, the second article support is positioned at the second station, and the first article support is positioned at the first station.

Therefore, the described example illustrates that reciprocal movement of the transfer beam between a first horizontal position and a second horizontal position along a first axis may reciprocally move an article support between two stations. Articles may be transferred to sequential article supports at the stations to thereby convey articles along the first axis. Rotational movement of a first drive connected to the transfer beam may move the transfer beam reciprocally along a linear axis—i.e., a first horizontal axis. In some embodiments of the invention, rotation of the first drive may be converted to linear reciprocal movement of the transfer beam substantially parallel to the first horizontal axis. Moreover, while embodiments described herein may comprise a first drive configured to rotate, embodiments of the invention are not so limited. For example, the first drive may comprise a hydraulic actuator, screw actuator, wheel and axle type actuator, cam actuator, pneumatic actuator, other types of linear actuators, and/or other such types of actuators that may be configured to produce linear or rotational motion.

Consistent with some embodiments of the invention, barrels may be conveyed between two or more stations associated with a barrel handling process by a barrel handling and manufacturing apparatus consistent with embodiments of the invention that includes a transfer beam that reciprocally moves along a first axis to thereby convey barrels supported in barrel supports coupled to the transfer beam from a first position/station to a second position/station. In general, each barrel support is configured to support a barrel during conveyance between two stations/positions. Moreover, the transfer beam may reciprocally move along a second axis to thereby load a barrel into a barrel support and unload a barrel from a barrel support at each station.

Consistent with embodiments of the invention, an apparatus, system, and process for handling and manufacturing barrels is provided. In some embodiments, at least two barrel supports may be coupled to a transfer beam, where the transfer beam may be configured to reciprocally move along a first axis. The reciprocal movement of the transfer beam may move the at least two barrel supports between corresponding stations—a first of the barrel supports may move between an entry station and a processing station, and a second of the barrels supports may move between the processing station and an exit station. Therefore, consistent with some embodiments of the invention, a barrel may be loaded into the first barrel support; conveyed to the processing station; loaded from the first barrel support into the processing station; loaded into the second barrel support from the processing station; and loaded from the second barrel support into the exit station.

In some embodiments, a number of barrel supports of an apparatus consistent with embodiments of the invention may correspond to a number of stations, areas, and/or positions associated with the barrel manufacturing process. For example, if the barrel manufacturing process has associated therewith an entry station, a first processing station, a second processing station, and an exit station, the barrel handling apparatus may include a first barrel support for supporting a barrel conveyed from the entry station to the first processing station, a second barrel support for supporting a barrel conveyed from the first processing station to the second processing station, and a third barrel support for supporting a barrel conveyed from the second processing station to the exit station. Consistent with some embodiments of the invention, a process for manufacturing barrels may utilize an apparatus as described herein to convey barrels. In general, barrels as used herein may refer to partially formed barrels at any stage of fabrication in a barrel manufacturing process. Some embodiments of the invention may handle and convey partially formed wooden barrels at any stage after forming a barrel exterior by joining wooden staves together (e.g., without a top or bottom or permanent joining bands).

Turning now to the drawings, wherein like numbers denote like parts throughout the several views, FIG. 1 provides an isometric view of a barrel handling and manufacturing apparatus 10 consistent with some embodiments of the invention. As shown, the apparatus 10 comprises a transfer beam 12, where at least a portion of the transfer beam 12 is configured to reciprocally move (i.e., in both directions) along a first axis 14. As shown, a first drive 15 may be connected to the transfer beam 12 with a linkage 16, where the first drive 15 is configured to drive movement of the at least a portion of the transfer beam 12 along the first axis 14. In general, the first drive may comprise an electrical actuator, a pneumatic actuator, a hydraulic actuator, a mechanical actuator, and/or other similar types of actuator. The apparatus 10 further comprises barrel supports 18*a*, 18*b*, 18*c*, 18*d* coupled to the transfer beam 12, where each barrel support 18*a-d* is configured to support a barrel during movement of the transfer beam 12 such that a barrel may be conveyed between stations spaced apart along the first axis via the barrel supports 18*a*, 18*b*, 18*c*, 18*d* until reaching an exit ramp 20 coupled to the transfer beam 12. As will be explained in further detail herein, at least a portion of the transfer beam 14 may be configured to reciprocally move along a second axis 22 between a first position and a second position. In the embodiment shown in FIG. 1, the transfer beam 14 may be lifted from the first position to the second position to load a barrel into or unload a barrel from a barrel support 18*a*, 18*b*, 18*c*, 18*d* at a station.

As shown in the embodiment illustrated in FIG. 1, the transfer beam 12 may be supported by and slidably coupled to support members 24, where the support members 24 may be parallel to the first axis 14 and may be configured to facilitate the movement of the transfer beam 12 along the first axis 14. Consistent with some embodiments of the invention, the transfer beam 12 may be slidably coupled to the support members 24 with one or more bearings or other such structure configured to reduce friction. Moreover, the support members may be removably coupled to a support surface to thereby support the transfer beam 12. In addition, one or more barrel clamps 26 may be coupled to the transfer beam 12 and positioned proximate each barrel support 18*a-d* to thereby engage at least a portion of a barrel positioned in the barrel support 18*a-d* when in an engaged (i.e., closed) position. Consistent with embodiments of the invention, the at least one barrel clamp 26 may be in a closed position when a barrel is being conveyed in the barrel support between stations. The at least one barrel clamp 26 may be in an open position such that a portion of a barrel in the barrel support 18*a-d* is not engaged such that a barrel may be loaded into and unloaded from the barrel support 18*a-d*. In FIG. 1, the apparatus 10 includes a pair of oppositely facing clamps 26 positioned approximate each barrel support 18*a-d* and configured to engage a side of a barrel positioned in a respective barrel support when the clamps 26 are in a closed position.

Figure 2A:
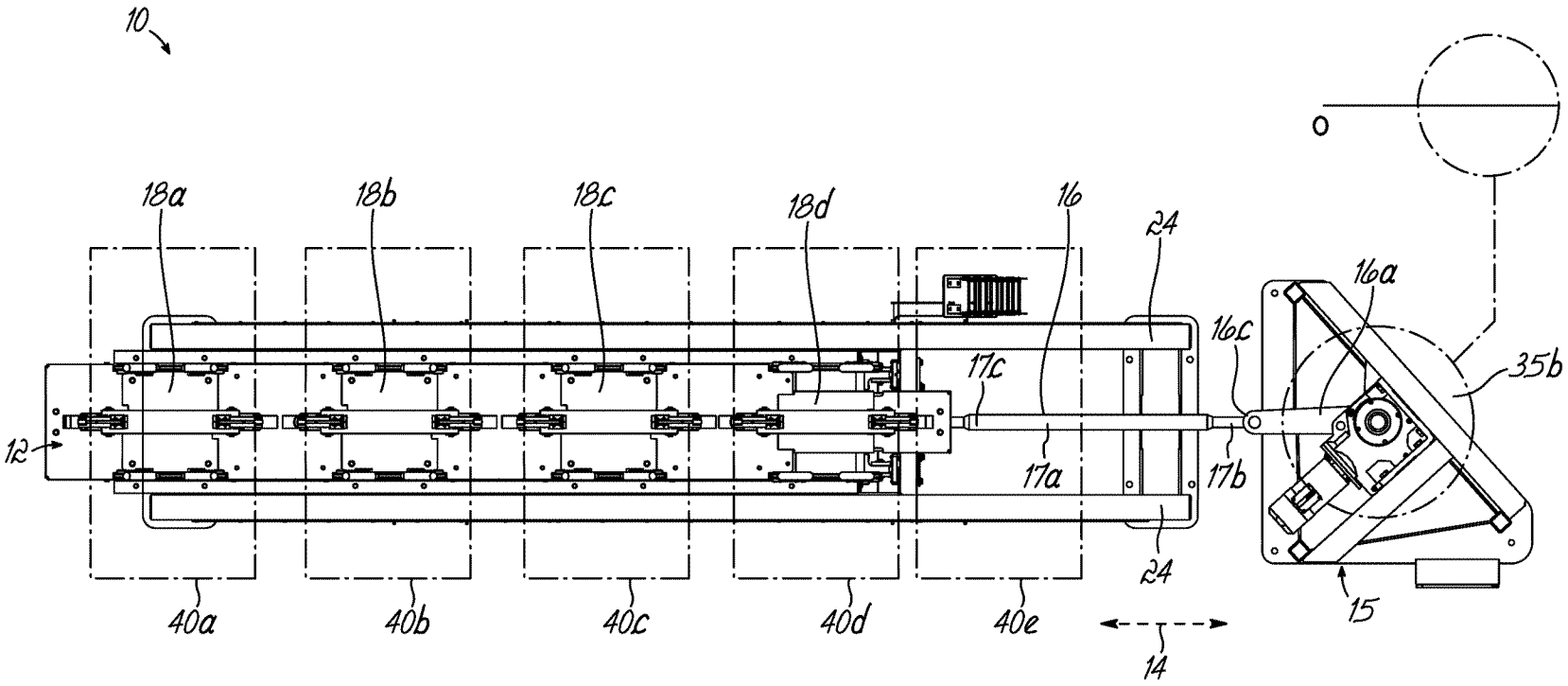
FIGS. 2A-C provide top views of the apparatus of FIG. 1.
Figure 2B:
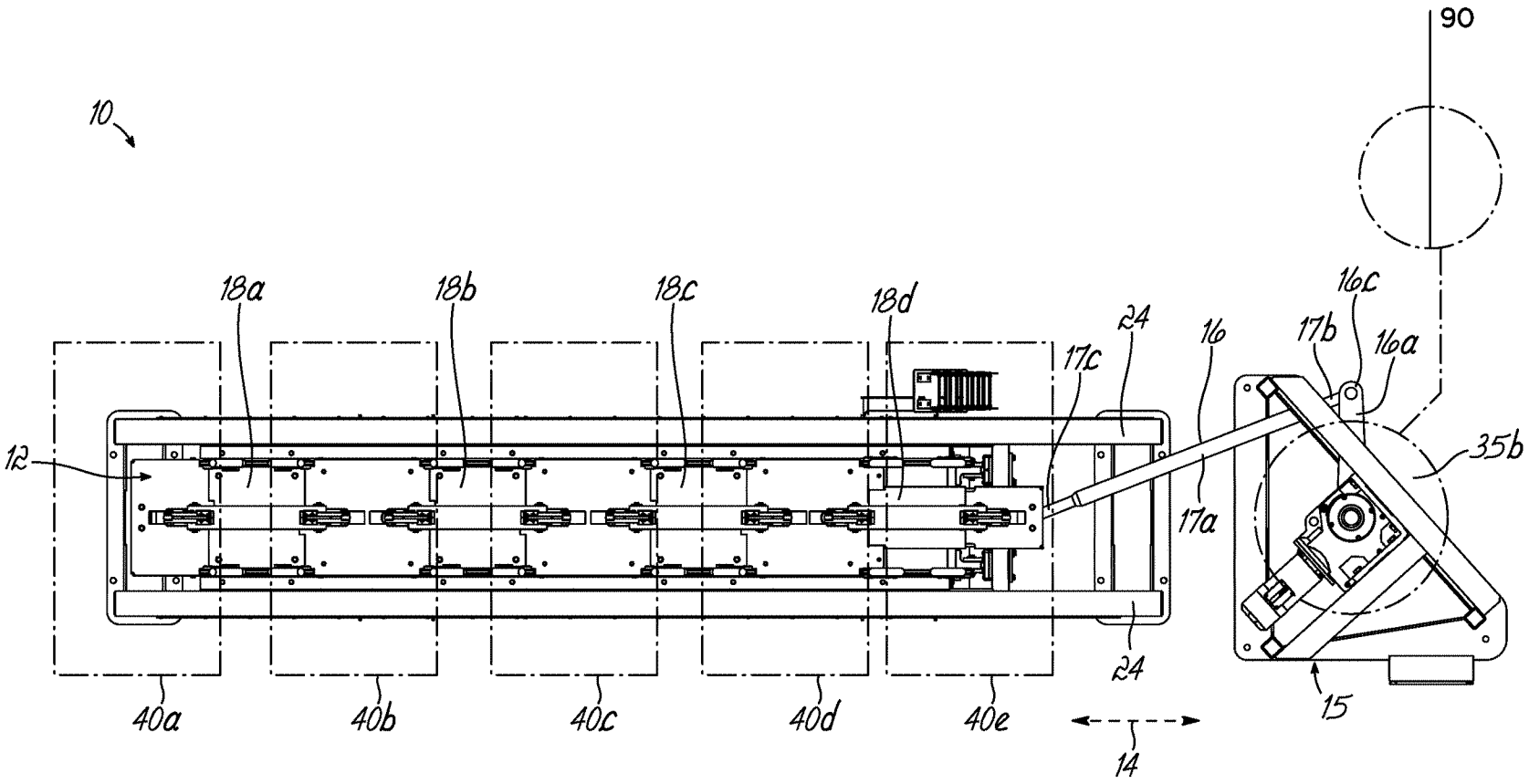
Figure 2C:
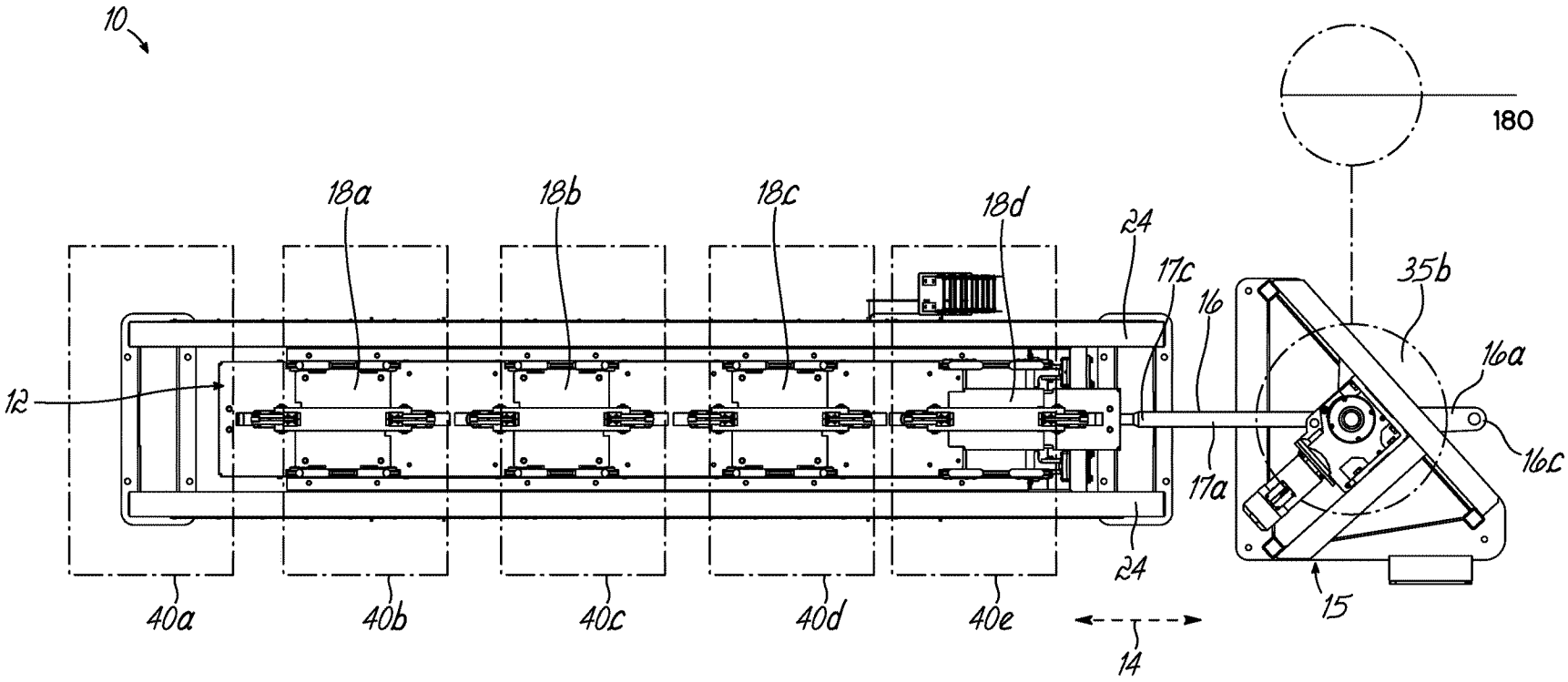
Figure 3:
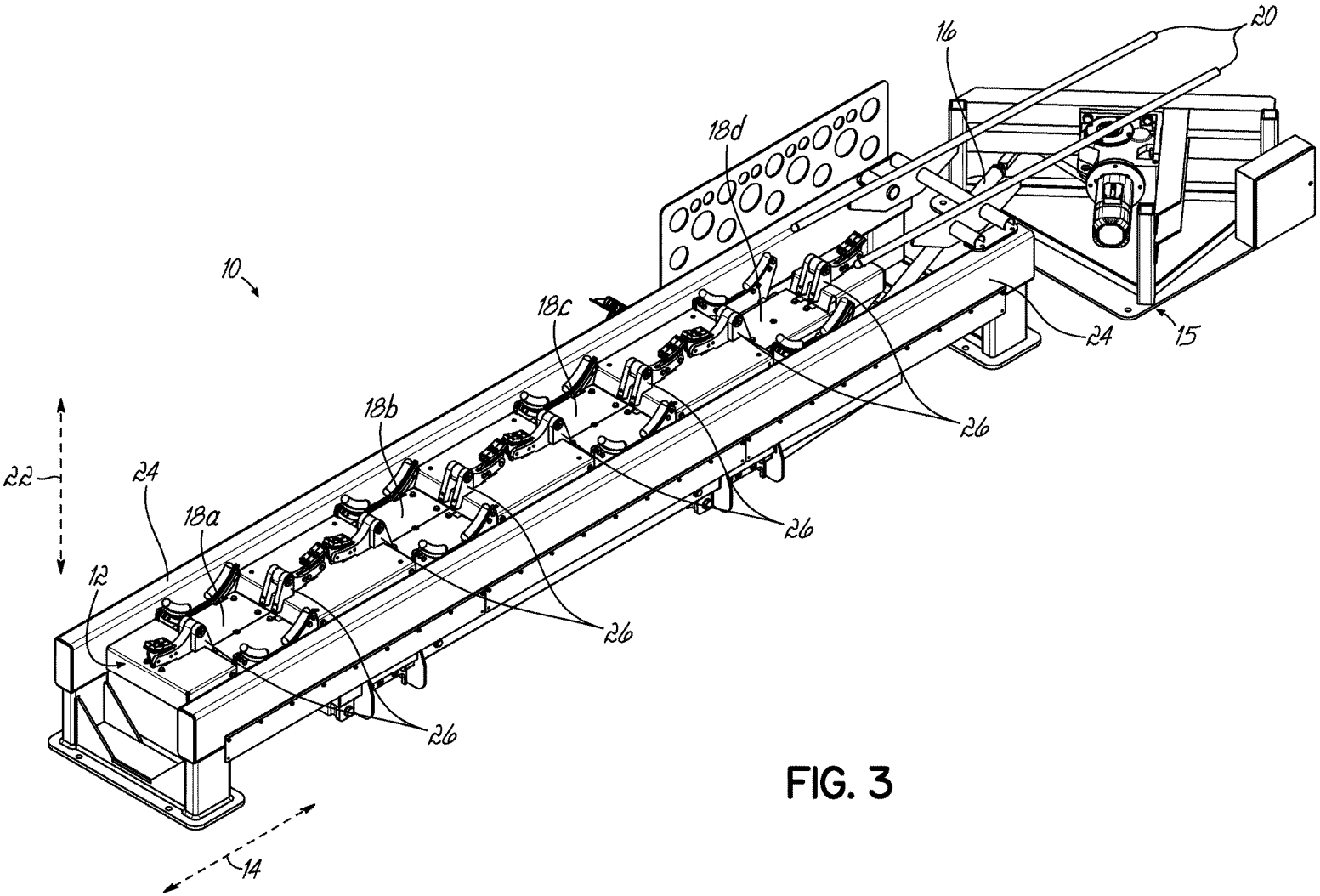
FIG. 3 provides an isometric view of the apparatus of FIG. 1.
Figure 4:
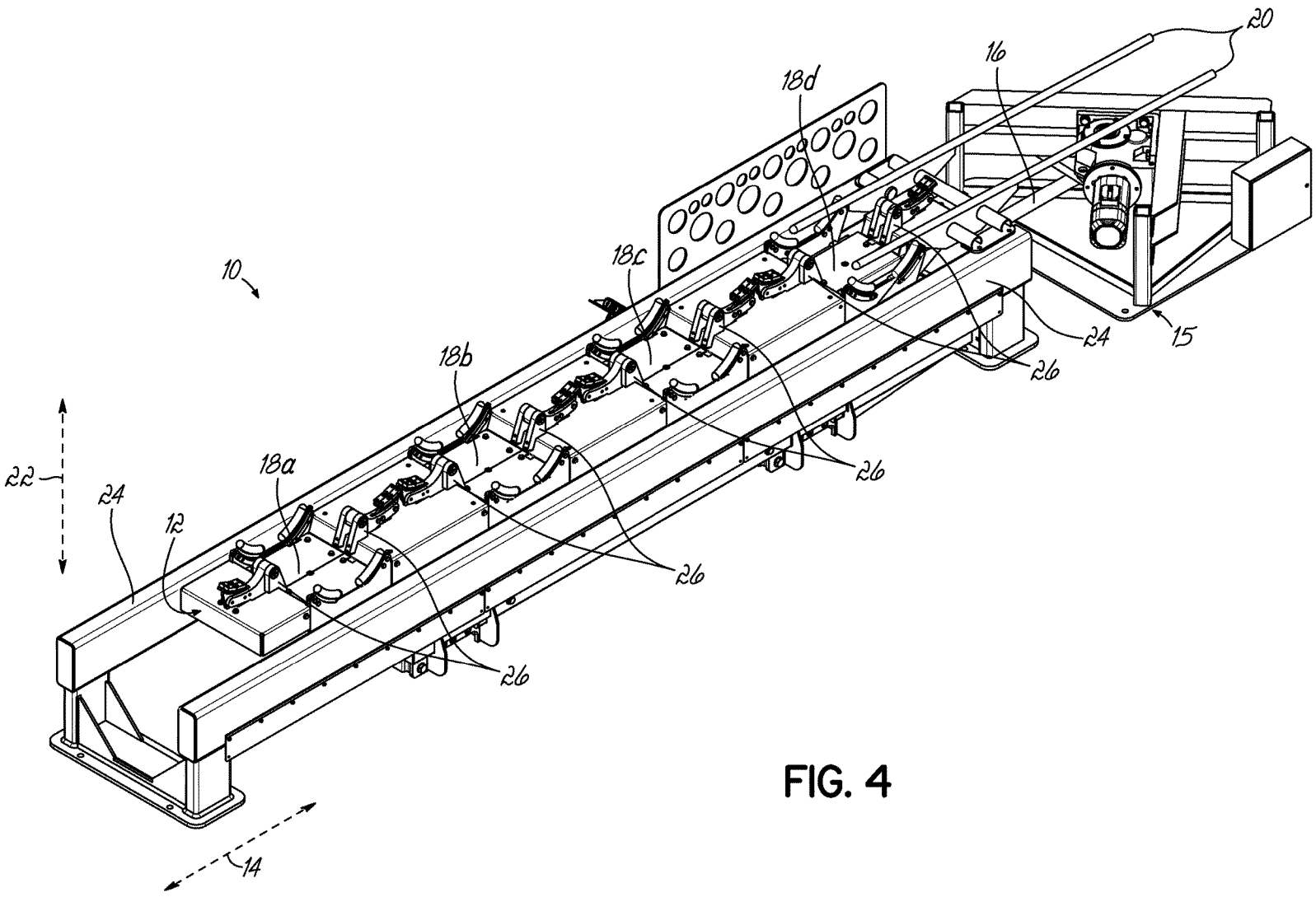
FIG. 4 provides an isometric view of the apparatus of FIG. 1.

As discussed, consistent with embodiments of the invention, linkage 16 may be connected between the transfer beam 12 and the first drive 15, such that rotation of the first drive 15 may reciprocally move the transfer beam along the first axis 14. Therefore, a position of the transfer beam 12 on the first axis may be described with respect to an angle of rotation associated with the first drive. In this regard, FIGS. 2A-C provide top views of the apparatus 10 that illustrates a positioning of the transfer beam 12 and therefore each barrel support 18*a*, 18*b*, 18*c*, 18*d* at different angles of rotation 35*a*, 35*b*, 35*c* of the first drive. In this regard, FIG. 1 is an isometric view of the apparatus 10 corresponding to the angle of rotation of the first drive 15 shown in FIG. 2A; FIG. 3 is an isometric view of the apparatus 10 corresponding to the angle of rotation of the first drive 15 shown in FIG. 2B; and FIG. 4 is an isometric view of the apparatus 10 corresponding to the angle of rotation of the first drive 15 shown in FIG. 2C.

Consistent with embodiments of the invention, rotation of the first drive 15 reciprocally moves the barrel supports 18*a*, 18*b*, 18*c*, 18*d* between positions/stations 40*a*, 40*b*, 40*c*, 40*d*, 40*e* associated with a barrel manufacturing and/or handling process such that supported barrels may be conveyed along the first axis to each station 40*a*, 40*b*, 40*c*, 40*d*, 40*e* associated with the barrel manufacturing process. As will be appreciated, an angle of rotation of 0° of the first drive 15 (shown in FIG. 2A) may be referred to as a first horizontal position of the transfer beam 12, and an angle of rotation of 180° of the first drive 15 (shown in FIG. 2C) may be referred to as a second horizontal position of the transfer beam. In the embodiment shown in FIGS. 1-4, a first barrel support 18*a* may convey a barrel from a first station 40*a* to a second station 40*b*; a second barrel support 18*b* may convey the barrel from the second station 40*b* to a third station 40*c*; a third barrel support 18*c* may convey the barrel from the third station 40*c* to a fourth station 40*d*; and a fourth barrel support 18*d* may convey the barrel from the fourth station 40*d* to a fifth station. The first station 40*a* may correspond to an entry station, where a barrel in an initial state associated with the manufacturing process may be loaded onto the first barrel support 18*a*. The fifth station may correspond to an exit station, where a barrel in a later state associated with the manufacturing process may be unloaded from the fourth barrel support 18*d* and placed on the exit ramp 20 shown in FIG. 1 after being processed at one or more of the other stations.

Referring to FIG. 2A, the angle of rotation 35*a* (in this example, 0°) associated with the first drive 15 positions the transfer beam 12 such that the first barrel support 18*a* is at the first station 40*a*, the second barrel support 18*b* is positioned at the second station 40*b*, the third barrel support 40*c* is positioned at the third station 40*c*, and the fourth barrel support is positioned at the fourth station 40*d*. In FIG. 2B, the angle of rotation 35*b* of the first drive 15 positions the transfer beam 12 such that the first drive 15 positions the barrel supports 18*a-d* between the stations 40*a-e* associated with each barrel support 18*a-d*. In FIG. 2C, the angle of rotation 35*c* of the first drive positions the transfer beam 12 such that the first barrel support 18*a* is positioned at the second station 40*b*, the second barrel support 18*b* is positioned at the third station 40*c*, the third barrel support 18*c* is positioned at the fourth station 40*d*, and the fourth barrel support 18*d* is positioned at the fifth station 40*e*. Therefore, as illustrated in FIGS. 2A-C, the transfer beam may reciprocally move such that the barrel supports 18*a-d* may be alternatively positioned at respective stations 40*a-e*.

While in FIGS. 2A-C, the angles of rotation 35*a-c* are labeled as 0°, 90°, and 180°, respectively, the angles of rotation 35*a-c* are relative values and not absolute values; hence embodiments of the invention are not limited to the values provided herein. Moreover, in general, while FIGS. 2A-C illustrate the positioning of the transfer beam 12 at the relative angles of rotation of 0°, 90°, and 180°, it should be understood that the first drive may rotate 360°. Therefore, the position of the transfer beam 12 along the first axis 14 is generally sinusoidal, such that the position of the transfer beam 12 at 270° corresponds to the position of the transfer beam 12 90°, and the position of the transfer beam 12 at 360° corresponds to the position of the transfer beam at 0°. Therefore, corresponding with rotation of the first drive 15 starting at 0° the transfer beam 12 may be positioned as shown in FIGS. 1 and 2A. As the first drive 15 rotates from 0° to 180°, the transfer beam correspondingly moves from the position shown in FIG. 2A through the position shown in FIGS. 2B and 3 to the position shown in FIGS. 2C and 4. As the first drive rotates from 180° to 360° (i.e., 0°), the transfer beam correspondingly moves from the position shown in FIGS. 2C and 4, through the position shown in FIGS. 2B and 3 to the position shown in FIGS. 1 and 2A. At the relative angle of rotation values of 0° and 180°, barrels may be loaded into/unloaded from the barrel supports 18*a-d* at the stations 40*a-e* at which the barrel supports 18*a-d* are positioned.

Figure 5:
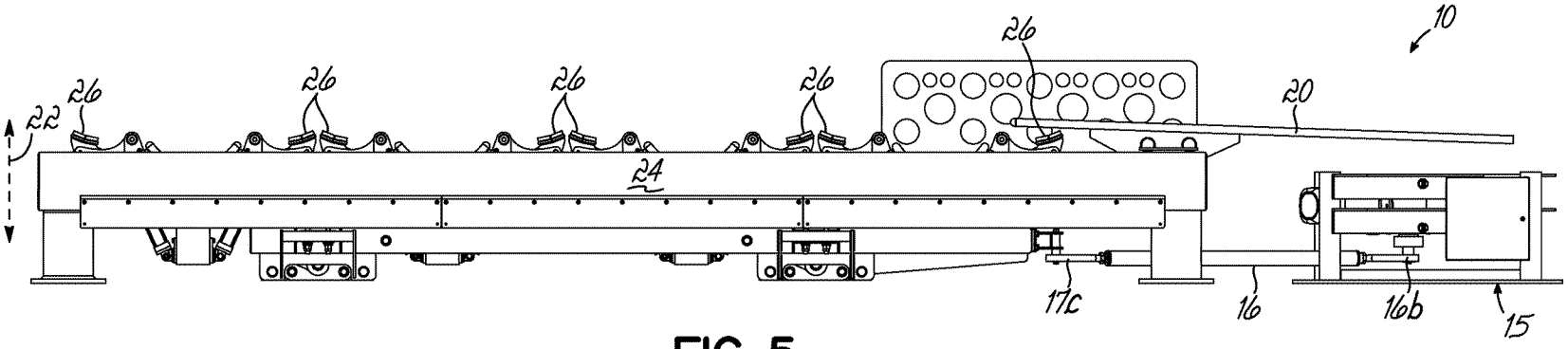
FIG. 5 provides a side view of the apparatus of FIG. 1.
Figure 6:
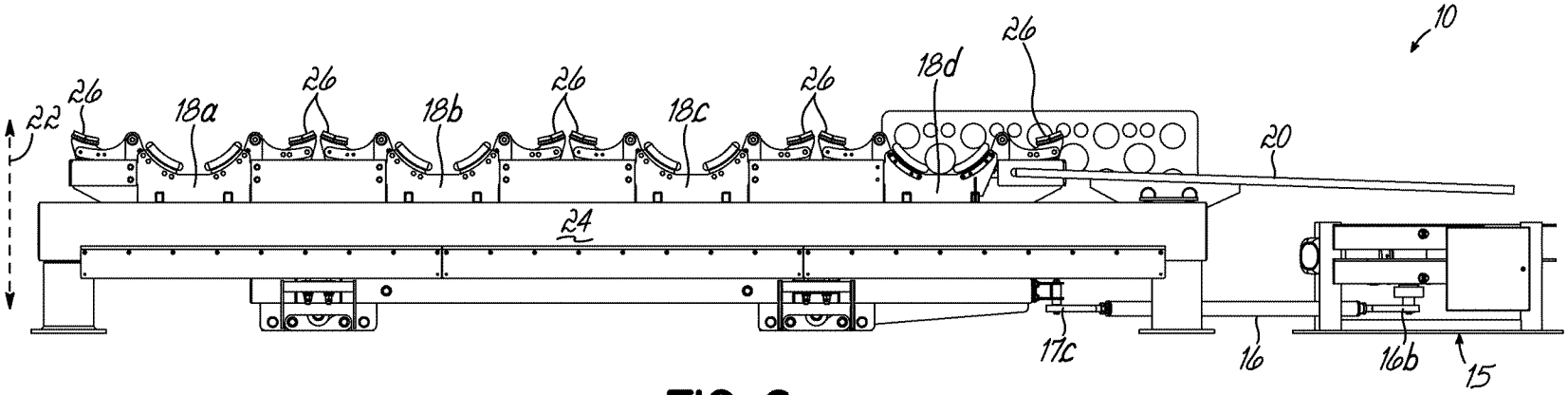
FIG. 6 provides a side view of the apparatus of FIG. 1.
Figure 7A:
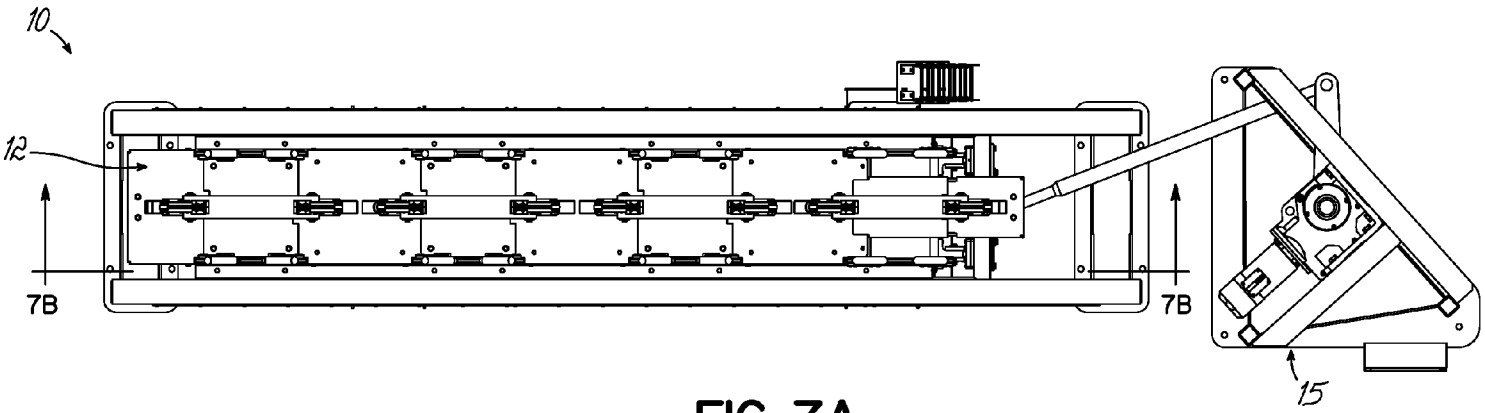
FIG. 7A provides a top view of the apparatus of FIG. 1 including a view line 7B-7B.
Figure 7B:
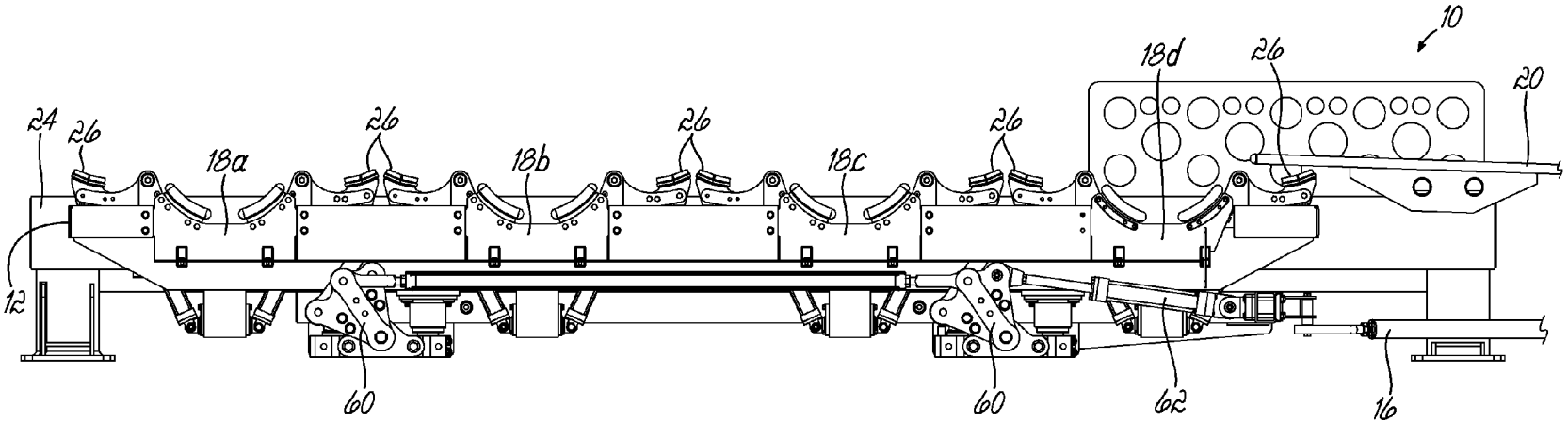
FIG. 7B provides a cross sectional side view of the apparatus of FIG. 1 along the view line 7B-7B of FIG. 7A.
Figure 8A:
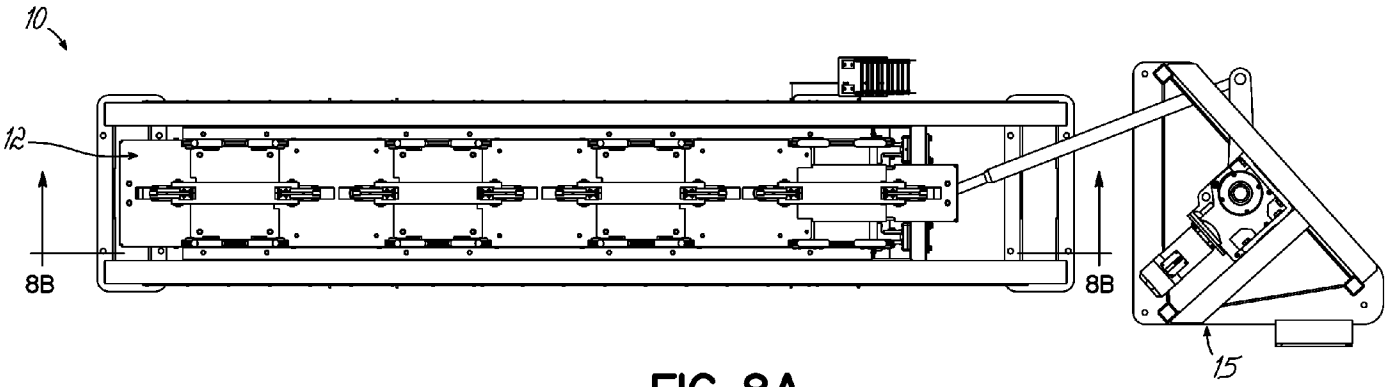
FIG. 8A provides a top view of the apparatus of FIG. 1 including a view line 8B-8B.
Figure 8B:
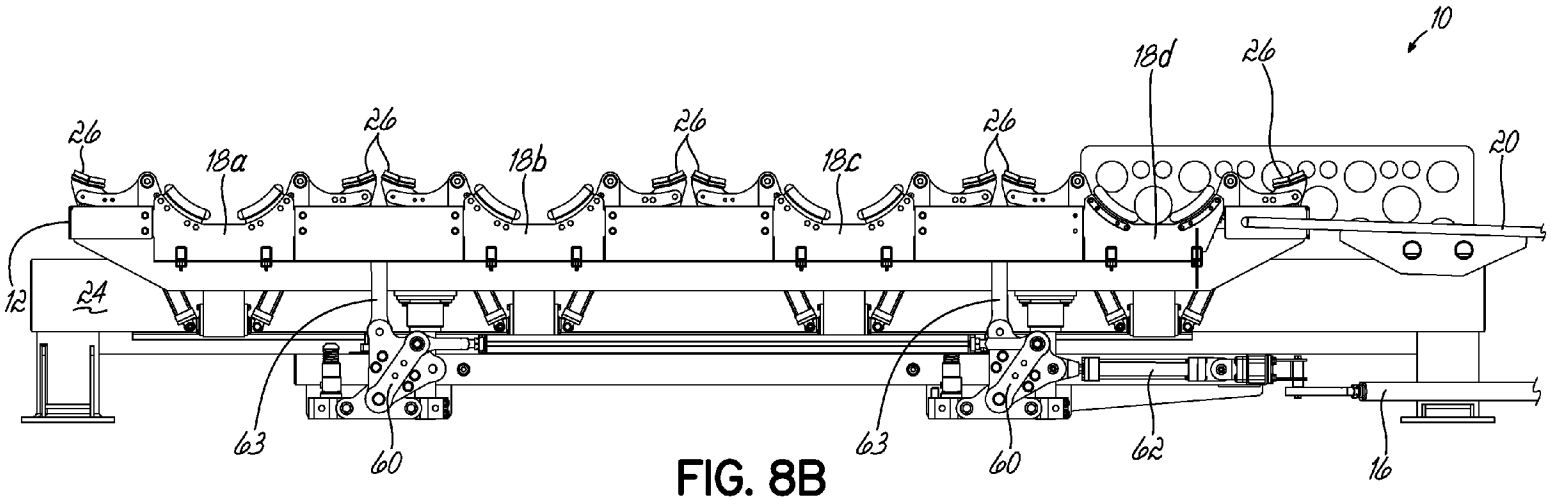
FIG. 8B provides a cross sectional side view of the apparatus of FIG. 1 along the view line 8B-8B of FIG. 8A.

Turning now to FIG. 5, this figure provides a side view of the apparatus 10 of FIG. 1. In this illustration, the clamps 26 are in an open position (i.e., not closed), and the transfer beam is in a first position relative to the second axis 22. FIG. 6 provides a side view of the apparatus 10 of FIG. 1, where the transfer beam 12 is in a second position relative to the second axis 22. Consistent with some embodiments of the invention, the transfer beam 12 may be coupled to a second drive that is configured to reciprocally move the transfer beam 12 along the second axis 22 between the first position shown in FIG. 5 and the second position shown in FIG. 6. In general, the second drive may comprise a hydraulic actuator, a pneumatic actuator, an electrical actuator, and/or a mechanical actuator. FIG. 7A provides a top view corresponding to the side view of FIG. 5 (i.e., the transfer beam 12 is in the first position along the second axis 22), where FIG. 7A includes view line 7B-7B. FIG. 7B is a cross-sectional side view along view line 7B-7B of FIG. 7A. Similarly, FIG. 8A provides a top view corresponding to the side view of FIG. 6 (i.e., the transfer beam 12 is in the second position along the second axis 22), where FIG. 8A includes view line 8B-8B. FIG. 8B is a cross-sectional side view along view line 8B-8B of FIG. 8A. As shown in FIGS. 7B and 8B, the apparatus 10 may include one or more rotating members 60 coupled to the transfer beam 12 and at least one piston 62 (e.g., a hydraulic cylinder), such that actuation of the piston 62 (e.g., by a second drive) may cause the rotation of the one or more rotating members 60 to thereby cause the transfer beam 12 to reciprocally move between the first position (FIG. 7B) and the second position (FIG. 8B). Consistent with some embodiments of the invention, the transfer beam 12 may be moved to the second position to load a barrel from a station to a barrel support 18*a-d* and unload a barrel from a barrel support 18*a-d* to a station. In these embodiments, the transfer beam 12 may be lowered to the first position to move the transfer beam 12 along the first axis 14 to thereby convey a barrel positioned in a barrel support 18*a-d* from a first station to a second station associated with the barrel support 18*a-d*. In general, the one or more rotating members 60 may be coupled to the transfer beam 12 via one or more linking members 63 such that rotation of the rotating members 60 by linear actuation of the at least one piston 62 may cause the linking members 63 to move parallel to the second axis and thereby raise and lower the transfer beam 12. As will be appreciated, in some embodiments the rotating members 60 may comprise cams connected to the linking members 63. Furthermore, the rotating members 60 are supported by the support members 24 and slidably coupled to the support members 24 with the transfer beam 12 such that the rotating members 60 and move along the first axis with the transfer beam 12.

Furthermore, as should be noted in FIGS. 2A-C and 5, the linkage 16 may comprise a first member 16*a* having a first end 16*b* connected to the first drive 15. The first member 16*a* of the linkage 16 may comprise a second end 16*c* that rotates about the axis of rotation of the first drive 15 when the first drive 15 rotates. The linkage 16 may comprise a second member 17*a* having a first end 17*b* rotatably coupled to the second end 16*c* of the first member 16*a*, where the axis of rotation therebetween may be substantially parallel to the axis of rotation of the first drive 15. A second end 17*c* of the second member may be rotatably coupled to the transfer beam 12 such that rotation of the first drive 15 is converted to reciprocal, linear movement along the first axis 14 of the transfer beam 12. An axis of rotation between the second end 17*c* of the second member 17 and the transfer beam 12 may be substantially parallel to the axis of rotation of the first drive 15.

Figure 9:
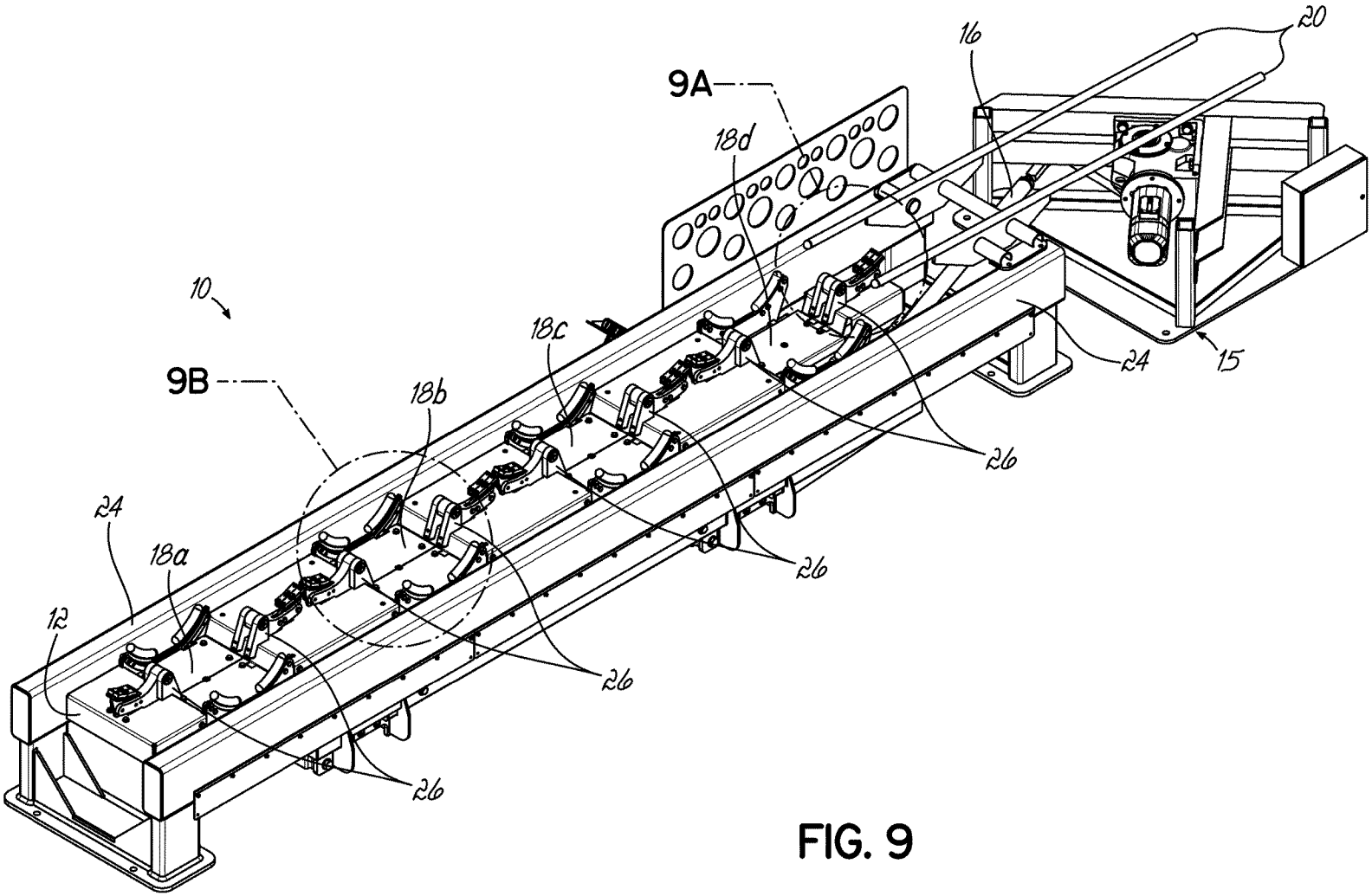
FIG. 9 provides an isometric view of the apparatus of FIG. 1 including detail views 9A and 9B.
Figure 9B:
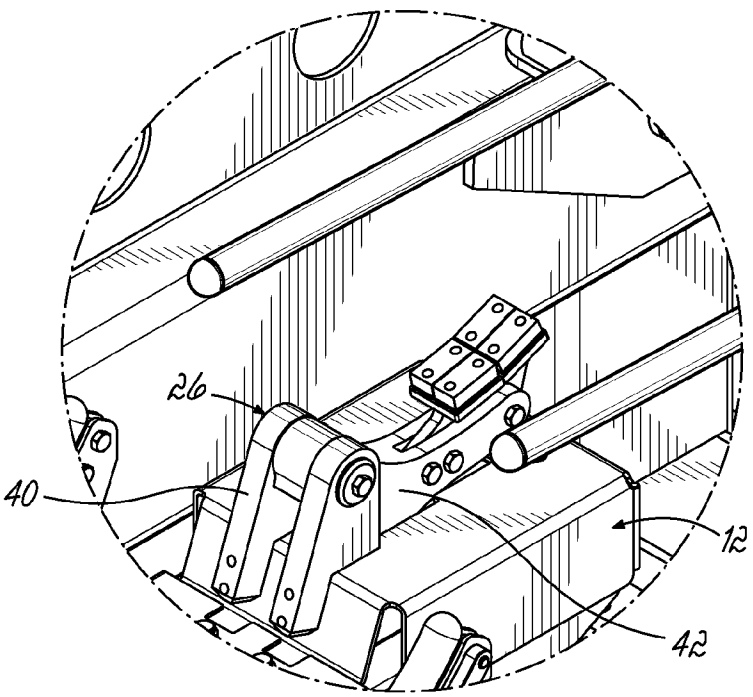
FIG. 9B provides an enlarged view of the detail view 9B of FIG. 9.
Figure 9A:
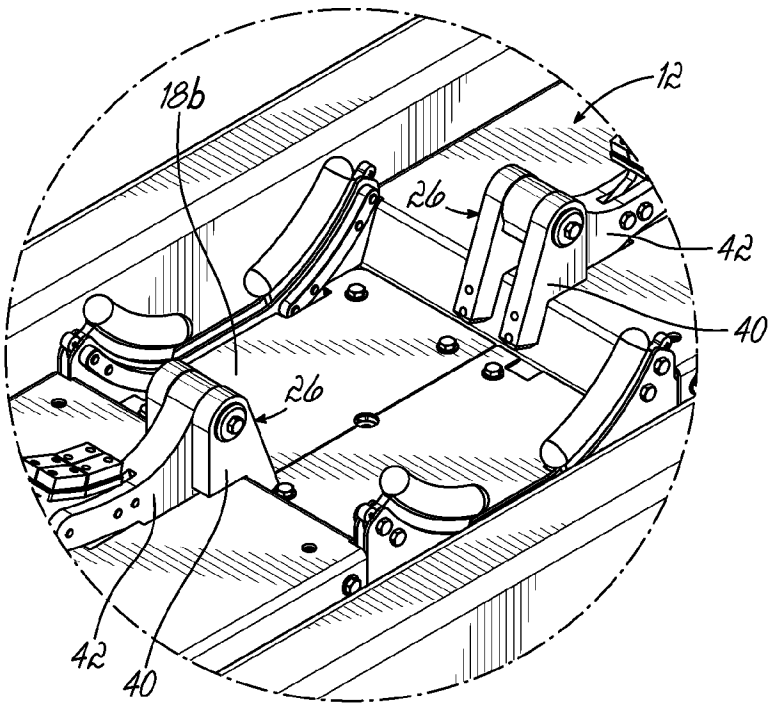
FIG. 9A provides an enlarged view of the detail view 9A of FIG. 9.
Figure 10:
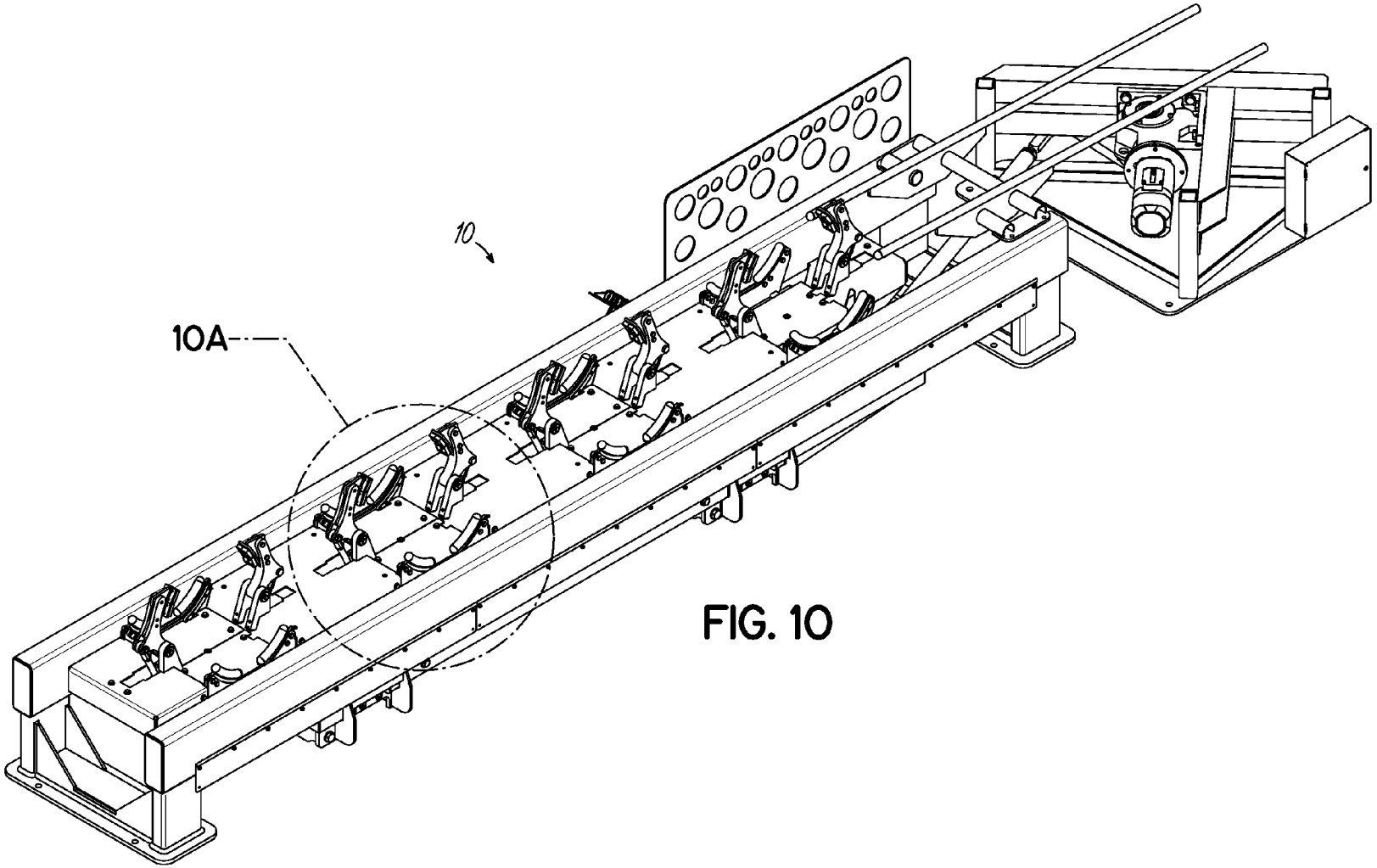
FIG. 10 provides an isometric view of the apparatus of FIG. 1 including detail view 10A.
Figure 10A:
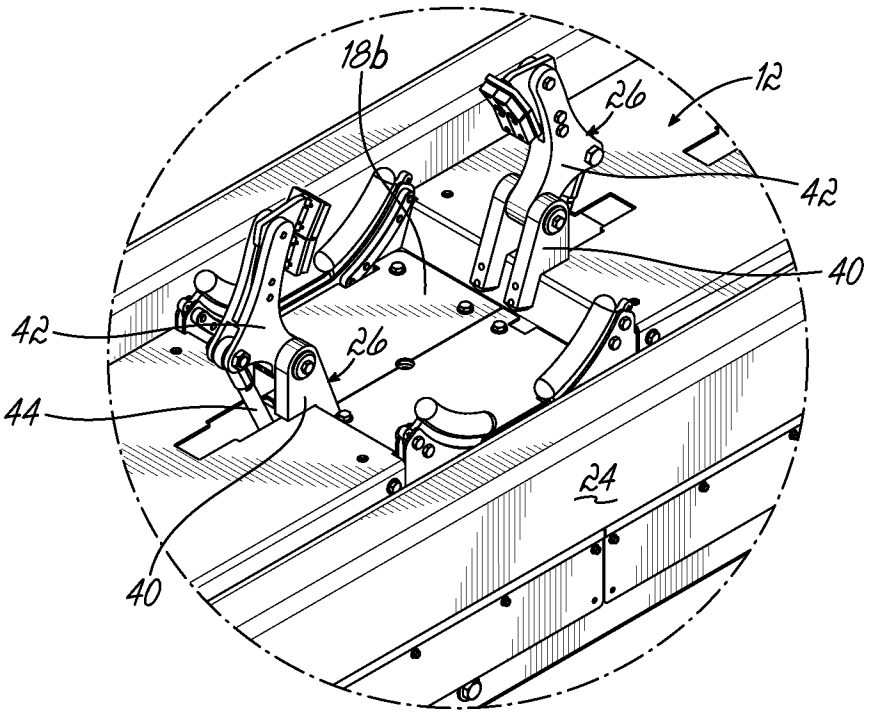
FIG. 10A provides an enlarged view of the detail view 10A of FIG. 10.

Turning now to FIGS. 9, 9A, and 9B, FIG. 9 provides an isometric view of the apparatus 10 of FIG. 1 including detail views 9A and 9B. FIG. 9A provides an enlarged view of the detail view 9A of FIG. 9. As shown in FIG. 9A, a pair of clamps 26 may be coupled to the transfer beam proximate a barrel support 18*b*. FIG. 9B provides an enlarged view of the detail view 9B. As shown in FIG. 9B, a clamp 26 may be rotatably coupled to the transfer beam such that the clamp may be rotated between an open position and closed position. FIG. 10 provides an isometric view of the apparatus of FIG. 1 including detail view 10A, where the clamps 26 have been rotated to the closed position. FIG. 10A provides an enlarged view of the detail view 10A of FIG. 10. As shown, when the clamps 26 are in the closed position, at least a portion of the clamps 26 may at least partially engage a barrel positioned in the barrel support 18*b*.

As shown in FIGS. 9-9B and FIGS. 10 and 10A, each clamp 26 may include a securing member 40 that is coupled to the transfer beam 12 and a rotating member 42 that is rotatably coupled to the securing member 40. As such, the clamp 26 may be moved to an open position (shown in detail in FIG. 9B) by rotating the rotating member 42 relative to the securing member 40 such that a portion of the clamp would not at least partially engage a barrel positioned in the barrel support 18*b*. As shown in FIG. 10A, the clamp 26 may be moved to the closed position such that at least a portion of the clamp 26 would engage a barrel supported by the barrel support 18*b* by rotating the rotating member 42. In the embodiment shown in FIG. 10A, the rotating member 26 may be rotated by a connected rod 44 that may be actuated.

Figure 11:
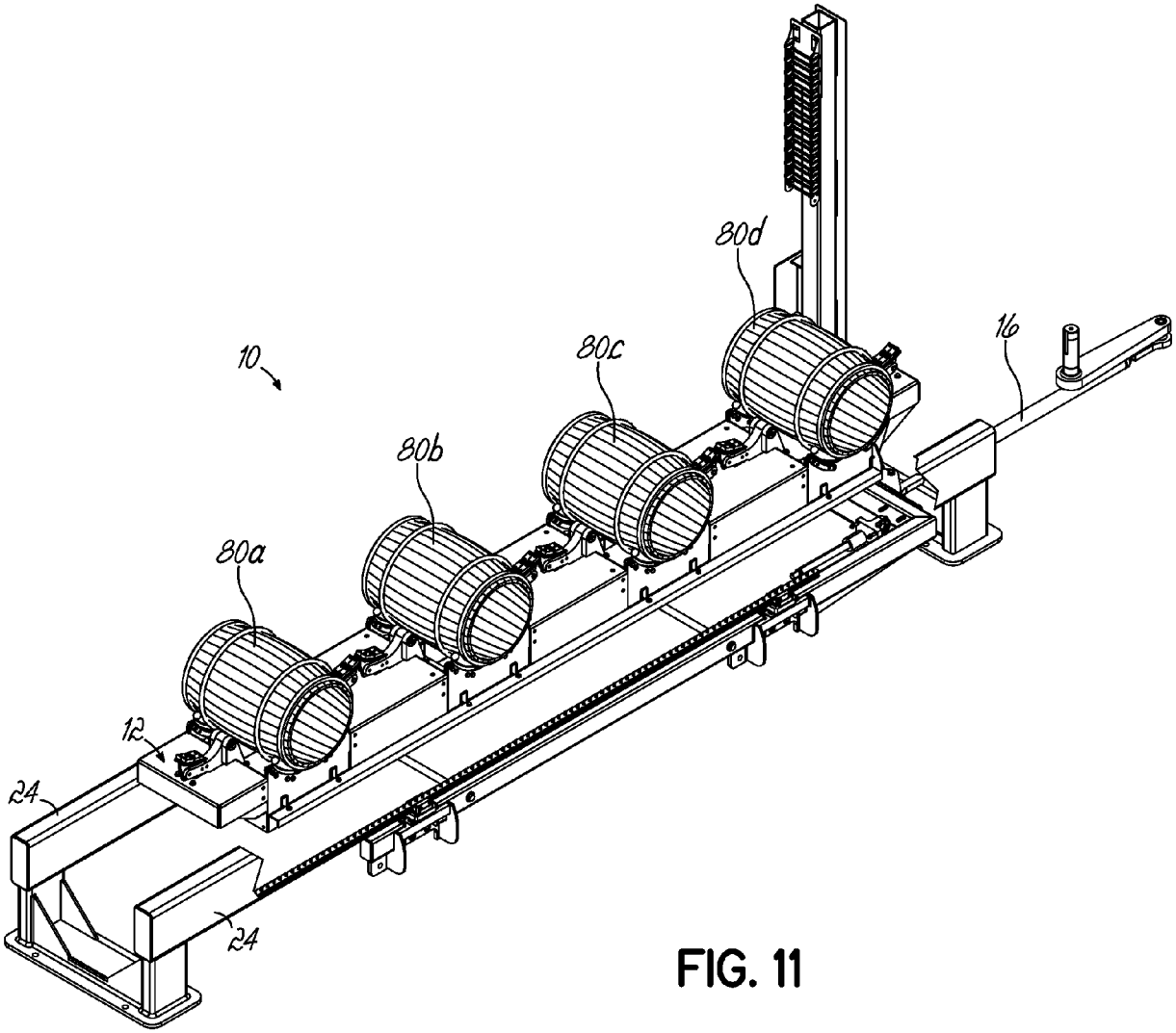
FIG. 11 provides an isometric view of the apparatus of FIG. 1 including wooden barrels and a cutaway detail.
Figure 12:
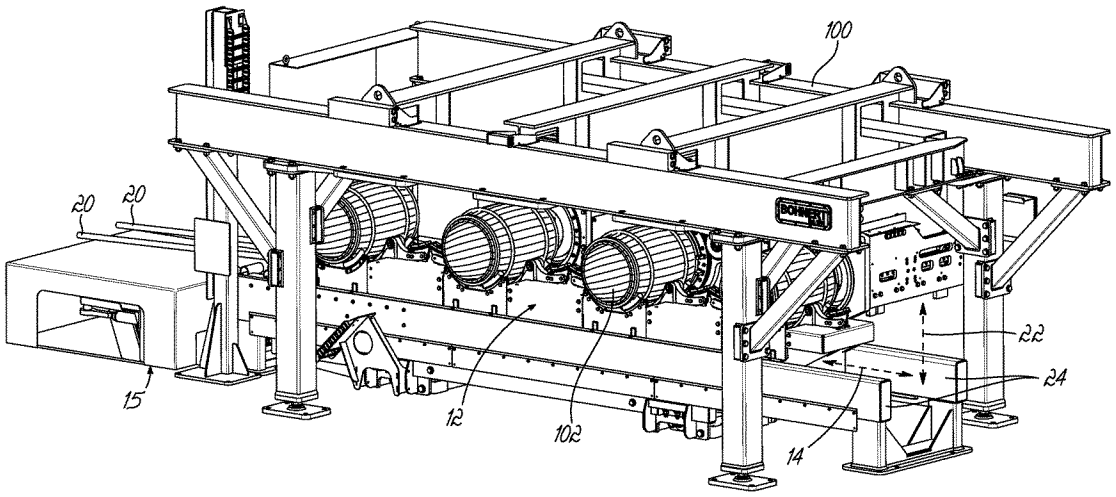
FIG. 12 provides an isometric view of the apparatus of FIG. 1 including a support frame.

FIG. 11 provides an isometric view of the apparatus 10 including a sectional cutout of a support member 24 to thereby illustrate an example slidable coupling consistent with embodiments of the invention. As shown, the transfer beam 12 may be supported by the support members 24 and coupled thereto with a low friction slidable structure. Furthermore, FIG. 11 illustrates the apparatus 10 supporting a wooden barrel 80*a-d* in each barrel support 18*a-d*. FIG. 12 provides an isometric view of the apparatus 10 consistent with some embodiments of the invention that includes a support frame 100 that may be coupled to one or more barrel processing devices that may correspond to stations of the barrel manufacturing process. In this example, wooden barrels 102 may be conveyed to each station by the apparatus and processed with a particular barrel processing device at a particular station. In general, barrel processing devices that may be positioned at each station may be associated with one or more barrel processes of a barrel manufacturing process, including for example a device for positioning steel hoops on an exterior surface of a wooden barrel, a device for evening spacing of wooden staves of a wooden barrel, a device for charring an interior surface of a wooden barrel, and/or other such barrel processing devices associated with a cooperage or other such barrel manufacturing and/or reconditioning processes. In embodiments of the invention that include the support frame 100, the one or more barrel processing devices coupled thereto may be positioned over the transfer beam 12, such that if a barrel breaks or a piece of the barrel falls off, debris from the broken barrel or piece will not fall into a barrel processing device but instead will fall onto a support surface (i.e., a manufacturing floor).

Referring to the location of the barrel supports 18*a-d* at the stations 40*a-e* based on the angles of rotation 35*a-c* of the first drive provided in FIGS. 2A-C and the first position of the transfer beam shown in FIG. 5 (referred to as the down position), and the second position of the transfer beam shown in FIG. 6 (referred to as the up position), the following example illustrates some apparatuses and processes consistent with some embodiments of the invention. A barrel may be received at the first station 40*a*, and the angle of rotation of the first drive may be at zero degrees, such that the first barrel support 18*a* is positioned at the first station 40*a*, which may be referred to as an entry station. The transfer beam may be moved to the up position, such that the barrel may be loaded into the first barrel support 18*a*. In this example, the apparatus may include barrel clamps 26 positioned proximate the barrel supports 18*a-d*, and the barrel clamps 26 may be in the open position (e.g., FIGS. 9A and 9B) such that the barrel may be loaded into the first barrel support 18*a*. After loading the barrel, the barrel clamps 26 may be rotated to the closed position (e.g., FIGS. 10 and 10A) to thereby engage at least a portion of the barrel and secure the barrel in the first barrel support 18*a*. In general, loading of a barrel may be performed by a barrel gripping device, such as a robotic arm configured to pick up a barrel and load the barrel into the first station 40*a*. However, in some embodiments, a barrel may be loaded into the first station by an operator. Furthermore, as will be appreciated, consistent with some embodiments of the invention, at each station and/or area, a barrel gripping device and/or component may engage a barrel to thereby hold the barrel and disengage to thereby release a barrel such that a barrel may be loaded into and unloaded from a barrel support. Therefore, conveyance of barrels consistent with embodiments of the invention generally comprises moving a barrel between two stations with via a first barrel support and transferring the barrel to a second barrel support by unloading the barrel from the first barrel support and loading the barrel into the second barrel support.

The transfer beam may be moved from the up position to the down position, and the first drive 15 may be rotated from the angle of rotation of 0° (e.g., FIG. 2A) to the angle of rotation of 180° (e.g., FIG. 2C) such that the first barrel support 18*a* is positioned at the second station 40*b*. The transfer beam may be moved from the down position to the up position, and the barrel clamps 26 may be rotated to the open position. The barrel may be unloaded from the first barrel support 18*a* and loaded into a barrel processing device located at the second station 40*b*. After unloading the barrel from the first barrel support 18*a* at the second station 40*b*, the transfer beam may be moved from the up position to the down position, and the first drive 15 may be rotated from 180° to 0°, such that the second barrel support 18*b* is positioned at the second station 40*b*. As will be appreciated, loading and/or unloading a barrel from a barrel support may be performed by a component of a barrel processing station configured to engage and hold the barrel, such that when the transfer beam is lowered to the down position, the barrel remains at the barrel processing station. While in the example provided herein, barrels may be loaded and/or unloaded via a component of a barrel processing device positioned at a station, in other embodiments of the invention, a barrel may be loaded and/or unloaded with a robotic arm or other similar device configured to grab and move a barrel from and/or to a barrel support positioned at a station. In these embodiments of the invention, the transfer beam may not be configured to move along a vertical axis (i.e., up and down).

In this example, the barrel processing device located at the second station 40*b* may process the barrel, such as positioning metal hoops on the exterior of the barrel to thereby support a shape of the barrel. After such processing, the transfer beam may be moved from the down position to the up position, and the barrel may be unloaded from the barrel processing device at the second station 40*b* to the second barrel support 18*b*. The barrel clamps 26 may be rotated to the closed position to thereby engage at least a portion of the barrel and secure the barrel in the second barrel support 18*b*. After loading the barrel in the second barrel support 18*b*, the transfer beam 12 may be moved from the up position to the down position, and the first drive 15 may be rotated from the angle of rotation 0° to 180°, such that the second barrel support 18*b* is positioned at the third station 40*c*.

The transfer beam 12 may be moved from the down position to the up position, and the clamps 26 may be rotated from the closed position to the open position. The barrel may be unloaded from the second barrel support 18*b* to a barrel processing device located at the third station 40*c*. The transfer beam 12 may be moved from the up position to the down position, and the first drive 15 may be rotated from the angle of rotation of 180° to 0°, such that the third barrel support 18*c* is positioned at the third station 40*c*. The barrel processing device located at the third station 40*c* may process the barrel, such as applying opposite forces to corresponding interior and exterior surfaces of the barrel with casters while rotating the barrel such that staves of the barrel may be adjusted. After such processing, the transfer beam may be moved from the down position to the up position, and the barrel may be unloaded from the barrel processing device at the third station 40*c* to the third barrel support 18*c*. The barrel clamps 26 may be rotated to the closed position to thereby engage at least a portion of the barrel and secure the barrel in the third barrel support 18*c*. After loading the barrel in the third barrel support 18*c*, the transfer beam 12 may be moved from the up position to the down position, and the first drive 15 may be rotated from the angle of rotation 0° to 180°, such that the third barrel support 18*c* is positioned at the fourth station 40*d*.

The transfer beam 12 may be moved from the down position to the up position, and the clamps 26 may be rotated from the closed position to the open position. The barrel may be unloaded from the third barrel support 18*c* to a barrel processing device located at the fourth station 40*d*. The transfer beam 12 may be moved from the up position to the down position, and the first drive 15 may be rotated from the angle of rotation of 180° to 0°, such that the fourth barrel support 18*d* is positioned at the fourth station 40*d*. The barrel processing device located at the fourth station 40*d* may process the barrel, such as coupling and/or adjusting one or more metal hoops to surround a circumference of the barrel. After such processing, the transfer beam 12 may be moved from the down position to the up position, and the barrel may be unloaded from the barrel processing device at the fourth station 40*d* to the fourth barrel support 18*d*. The barrel clamps 26 may be rotated to the closed position to thereby engage at least a portion of the barrel and secure the barrel in the fourth barrel support 18*d*. After loading the barrel in the fourth barrel support 18*d*, the transfer beam 12 may be moved from the up position to the down position, and the first drive 15 may be rotated from the angle of rotation 0° to 180°, such that the fourth barrel support 18*d* is positioned at the fifth station 40*e*.

The transfer beam 12 may be moved from the down position to the up position, and the clamps 26 may be rotated from the closed position to the open position. The barrel may be unloaded from the fourth barrel support 18*d* to the fifth station 40*e*. The transfer beam 12 may be moved from the up position to the down position, and the first drive 15 may be rotated from the angle of rotation of 180° to 0°, such that the fourth barrel support 18*d* is positioned at the fourth station 40*d*. In this example, the fifth station 40*e* corresponds to an exit station, such that when the barrel is unloaded from the fourth barrel support 18*d*, the barrel exits the apparatus 10.

Therefore, embodiments consistent with the invention provide an apparatus and process for handling, processing, and/or manufacturing articles. Some embodiments of the invention comprise conveying articles using a reciprocally moving transfer beam coupled to one or more article supports. For example, a reciprocally moving transfer beam coupled with one or more article supports may be used to convey articles from a start station to an end station. In some embodiments, one or more manufacturing and/or processing steps may be performed at one or more stations between the start station and end station.

In some embodiments, the barrels are wooden barrels. Consistent with embodiments of the invention, a transfer beam coupled with one or more barrel supports may convey barrels to one or more stations associated with a barrel processing and/or manufacturing process. In some embodiments of the invention, one or more barrels may be conveyed with a reciprocally moving transfer beam coupled to one or more barrels supports for a barrel reconditioning process. In other embodiments of the invention, one or more barrels may be conveyed in a barrel handling/transportation implementation. For example, a reciprocally moving transfer beam coupled to one or more barrel supports may be used to convey unfilled and/or filled wooden barrels.

While particular embodiments have been described, it is not intended that the invention be limited thereto, as it is intended that the invention be as broad in scope as the art will allow and that the specification be read likewise. As discussed previously, some embodiments of the invention may be configured for conveyance and handling of various types of articles for handling and/or transportation. Moreover, it will be appreciated that more or less article supports than shown in the figures and described herein may be coupled to a transfer beam consistent with embodiments of the invention. In some embodiments, a number of article supports may correspond to a number of stations through which articles are to be conveyed. Furthermore, while some embodiments herein describe a first drive that provides rotational force to thereby reciprocally move a transfer beam, embodiments of the invention are not so limited. Other types of drives may be used. For example, a drive configured to provide a linear force may be connected to a transfer beam consistent with embodiments of the invention. Moreover, embodiments of the invention may be configured to convey articles between more or less stations associated with an article manufacturing, processing, and/or handling process than shown in the figures. It will therefore be appreciated by those skilled in the art that yet other modifications could be made without deviating from its spirit and scope as claimed.

What is claimed is:

1. A barrel handling apparatus comprising:

a first barrel support configured to support a first barrel;

a second barrel support configured to support a second barrel; and a transfer beam coupled to the first and second barrel supports and configured to convey the first barrel from a first position to a second position concurrently with conveying the second barrel from the second position to a third position by reciprocally moving the first barrel support between the first position and the second position and the second barrel support between the second position and the third position along a first axis, wherein the transfer beam is configured to convey the first barrel from the first position to the second position concurrently with conveying the second barrel from the second position to the third position by:

moving the first barrel support from the first position to the second position and the second barrel support from the second position to the third position along the first axis in a first direction while the first barrel is supported by the first barrel support and the second barrel is supported by the second barrel support; and thereafter unloading the first and second barrels from the first and second barrel supports and moving the first barrel support from the second position to the first position and the second barrel support from the third position to the second position along the first axis in a second, opposite direction from the first direction.

2. The barrel handling apparatus of claim 1, further comprising:

a first drive connected to the transfer beam that drives movement of the transfer beam along the first axis.

3. The barrel handling apparatus of claim 2, further comprising:

a linkage having a first end connected to the first drive and a second end connected to the transfer beam that converts a rotational movement of the first drive to movement of the transfer beam along the first axis.

4. The barrel handling apparatus of claim 3, wherein the linkage comprises:

a first member coupled to the first drive; and a second member rotatably coupled to the first member at a first end and the transfer beam at a second end, wherein an axis of rotation between the first member and the second member is substantially parallel to an axis of rotation of the first drive.

5. The barrel handling apparatus of claim 1, wherein the transfer beam is further configured to move the first barrel from a first position to a second position along a second axis.

6. The barrel handling apparatus of claim 5, further comprising:

a first drive connected to the transfer beam that drives movement of the transfer beam along the first axis; and a second drive connected to the transfer beam that drives movement of the transfer beam along the second axis.

7. The barrel handling apparatus of claim 1, wherein the transfer beam is further configured to unload the first and second barrels from the first and second barrel supports by moving the first and second barrel supports in a direction generally orthogonal to the first axis.

8. A barrel handling apparatus comprising:

a barrel support configured to support a barrel; and a transfer beam coupled to the barrel support and configured to convey the barrel from a first station to a second station by reciprocally moving the barrel support between the first station and the second station along a first axis, wherein the transfer beam is configured to convey the barrel from the first station to the second station by:

moving the barrel support from the first station to the second station along the first axis in a first direction while the barrel is supported by the barrel support; and thereafter unloading the barrel from the barrel support and moving the barrel support from the second station to the first station along the first axis in a second, opposite direction from the first direction.

9. The barrel handling apparatus of claim 8, wherein the transfer beam is further configured to move the barrel from a first position to a second position at each of the first and second stations by reciprocally moving the barrel support along a second axis.

10. The barrel handling apparatus of claim 9, further comprising:

a first drive connected to the transfer beam that drives movement of the transfer beam along the first axis.

11. The barrel handling apparatus of claim 10, wherein the first drive comprises an electrical actuator.

12. The barrel handling apparatus of claim 10, further comprising:

a linkage having a first end connected to the first drive and a second end connected to the transfer beam that converts a rotational movement of the first drive to movement of the transfer beam along the first axis.

13. The barrel handling apparatus of claim 9, further comprising:

a second drive connected to the transfer beam that drives the reciprocal movement of the transfer beam along the second axis.

14. The barrel handling apparatus of claim 13, wherein the second drive comprises a hydraulic actuator.

15. The barrel handling apparatus of claim 8, further comprising:

a pair of barrel holding clamps positioned on opposite sides of the barrel support and coupled to the transfer beam, the barrel holding clamps configured to rotatably move between an open position and a closed position, wherein the pair of barrel clamps are configured to at least partially engage a surface of the barrel when in the closed position.

16. The barrel handling apparatus of claim 8, further comprising:

at least one support member slidably coupled to the transfer beam and configured to rest on a support surface.

17. The barrel handling apparatus of claim 8, wherein the barrel support is a first barrel support, the apparatus further comprising:

a second barrel support configured to support a barrel, wherein the transfer beam is further configured to convey a supported barrel from the second station to a third station by reciprocally moving the second barrel support between the second station and the third station along the first axis.

18. The barrel handling apparatus of claim 17, further comprising:

a barrel unloading device positioned at the second station configured to unload a barrel from the first barrel support and load the barrel into the second barrel support.

19. A barrel handling process comprising:

moving a transfer beam from a first position to a second position to thereby convey a first barrel supported by a first barrel support coupled to the transfer beam from a first station to a second station;

thereafter moving the transfer beam from the second position to the first position after unloading the first barrel from the first barrel support; and thereafter loading the first barrel onto a second barrel support coupled to the transfer beam and moving the transfer beam from the first position to the second position to thereby convey the first barrel from the second station to a third station.

20. The barrel handling process of claim 19, further comprising:

moving the transfer beam from the second position to the first position; and moving the transfer beam from the first position to the second position to thereby convey the first barrel supported by a third barrel support coupled to the transfer beam from the third station to a fourth station.

21. The barrel handling process of claim 19, wherein moving the transfer beam from the first position to the second position comprises rotating a first drive connected to the transfer beam from an angle of rotation of 0° to an angle of rotation of 180°, and moving the transfer beam from the second position to the first position comprises rotating the first drive from an angle of rotation of 180° to an angle of rotation of 360°.

22. The barrel handling process of claim 19, further comprising:

unloading the first barrel from the first barrel support when the first barrel support is at the second station; and loading the first barrel into the second barrel support when the second barrel support is at the second station.

23. A barrel handling apparatus comprising:

a plurality of barrel supports configured to support a barrel;

a transfer beam coupled to each of the plurality of barrel supports and configured to convey barrels supported in the plurality of barrel supports to a plurality of stations by reciprocally moving along a first horizontal axis such that each barrel support is moved between two stations of the plurality of stations, wherein the transfer beam is configured to reciprocally move each barrel support in first and second directions along the first horizontal axis, and wherein the transfer beam is further configured to move between a first and second position along a second vertical axis such that barrels supported in the plurality of barrel supports are unloaded from the plurality of barrel supports when the transfer beam is in the second position.

24. The barrel handling apparatus of claim 23, further comprising:

a first drive configured to rotate about an axis of rotation;

a linkage connecting the first drive to the transfer beam and configured to convert rotation of the first drive to reciprocally move the transfer beam along the first axis.

25. The barrel handling apparatus of claim 24, wherein the linkage comprises:

a first member comprising a first end coupled to the first drive and a second end; and a second member comprising a first end rotatably coupled to the second end of the first member and a second end rotatably coupled to the transfer beam.

26. The barrel handling apparatus of claim 23 further comprising:

a second drive connected to the transfer beam and configured to move the transfer beam between the first position and the second position along the second vertical axis.

27. The barrel handling apparatus of claim 23 further comprising:

an unloading device positioned at each of the plurality of stations, and each respective unloading device is configured to unload a barrel supported by a respective barrel support of the plurality of barrel supports positioned at the respective station of the plurality of stations.

28. The barrel handling apparatus of claim 23, wherein a first station of the plurality of stations is an entry station and a second station of the plurality of stations is an exit station, and further comprising:

an exit ramp proximate the exit station configured to receive a barrel unloaded from a respective barrel support of the plurality of barrel supports positioned at the exit station.

29. A barrel handling process comprising:

after loading a barrel into a first barrel support positioned at a first station, moving a transfer beam coupled to the first barrel support along a first axis such that the first barrel support is positioned at a second station;

after moving the transfer beam coupled to the first barrel support along the first axis such that the first barrel support is positioned at the second station, unloading the barrel from the first barrel support at the second station;

after unloading the barrel from the first barrel support at the second station, moving the transfer beam along the first axis such that the first barrel support is positioned at the first station and a second barrel support coupled to the transfer beam is positioned at the second station;

after moving the transfer beam along the first axis such that the first barrel support is positioned at the first station and the second barrel support is positioned at the second station, loading the barrel into the second barrel support; and after loading the barrel into the second barrel support, moving the transfer beam along the first axis such that the second barrel support is positioned at a third station and the first barrel support is positioned at the second station.

30. The barrel handling apparatus of claim 29, wherein unloading the barrel from the first barrel support at the second station comprises:

moving the transfer beam from a first vertical position to a second vertical position along a second axis;

engaging the barrel to thereby hold the barrel when the transfer beam is at the second vertical position; and moving the transfer beam from the second vertical position to the first vertical position along the second axis to thereby unload the barrel from the first barrel support.

31. The barrel handling apparatus of claim 30, wherein loading the barrel into the second barrel support comprises:

moving the transfer beam from the first vertical position to the second vertical position along the second axis to thereby position the second barrel support proximate the engaged barrel;

disengaging the engaged barrel to thereby load the barrel into the second barrel support; and moving the transfer beam from the second vertical position to the first vertical position along the second axis.

* * * * *